US006024341A

United States Patent [19]

Gertz

[11] Patent Number: 6,024,341

[45] Date of Patent: Feb. 15, 2000

[54] CRASH ATTENUATOR OF COMPRESSIBLE SECTIONS

[75] Inventor: David C. Gertz, San Clemente, Calif.

[73] Assignee: Traffix Devices, Inc., San Clemente, Calif.

[21] Appl. No.: 09/073,122

[22] Filed: May 5, 1998

Related U.S. Application Data

[60] Provisional application No. 60/045,588, May 5, 1997.

[51] Int. Cl.[7] ..... A01K 3/00

[52] U.S. Cl. ..... 256/13.1; 256/1; 404/6

[58] Field of Search ..... 256/13.1, 1; 404/6, 404/9; 248/909

[56] References Cited

U.S. PATENT DOCUMENTS

| | | | |
|---|---|---|---|
| 3,643,924 | 2/1972 | Fitch | 256/1 |
| 4,321,989 | 3/1982 | Meinzer | 256/1 |
| 4,330,106 | 5/1982 | Chisholm | 256/13.1 |
| 4,407,484 | 10/1983 | Meinzer | 256/13.1 |
| 4,452,431 | 6/1984 | Stephens et al. | 256/13.1 |
| 4,674,911 | 6/1987 | Gertz | 256/13.1 |
| 5,022,782 | 6/1991 | Gertz et al. | 404/6 |
| 5,660,496 | 8/1997 | Muller et al. | 256/13.1 |
| 5,733,062 | 3/1998 | Oberth et al. | 256/13.1 |
| 5,791,812 | 8/1998 | Ivey | 256/13.1 |

*Primary Examiner*—Lynne Reichard
*Assistant Examiner*—David E. Bochna
*Attorney, Agent, or Firm*—Stout, Uxa, Buyan & Mullins, LLP; Donald E. Stout

[57] ABSTRACT

An energy absorbing guardrail crash attenuator system comprises a row of two or more compressible sections comprising left and right curved, metal side panels. The row of compressible sections extends in an axial direction from a front end and terminates in a back end that is engagable with a rigid backup. When the row is impacted by a vehicle in the axial direction, the compressible sections bend outwardly and absorb energy. When the row is impacted in a direction that is off of the axial direction, the row redirects the vehicle so as not to hit the "coffin corner" of the rigid backup. The front ends of the left and right metal panels are flexibly joined while the back ends are pivotly joined to the rearwardly adjacent section. The panels may have panel bending modifications for facilitating the axial compression of the sections. The row may have an axial movement guide to restrict lateral movement of the row of compressible sections. The front of the row may extend into an array of containers of particulate mass, such that the attenuation system performs gating and redirecting functions.

50 Claims, 14 Drawing Sheets

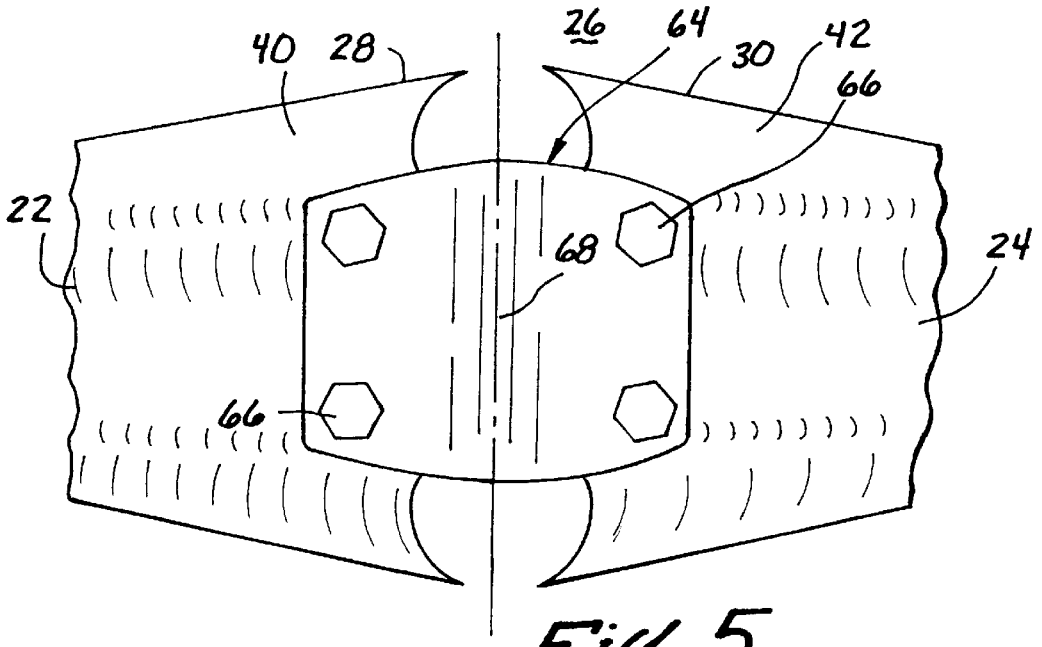
Fig. 5
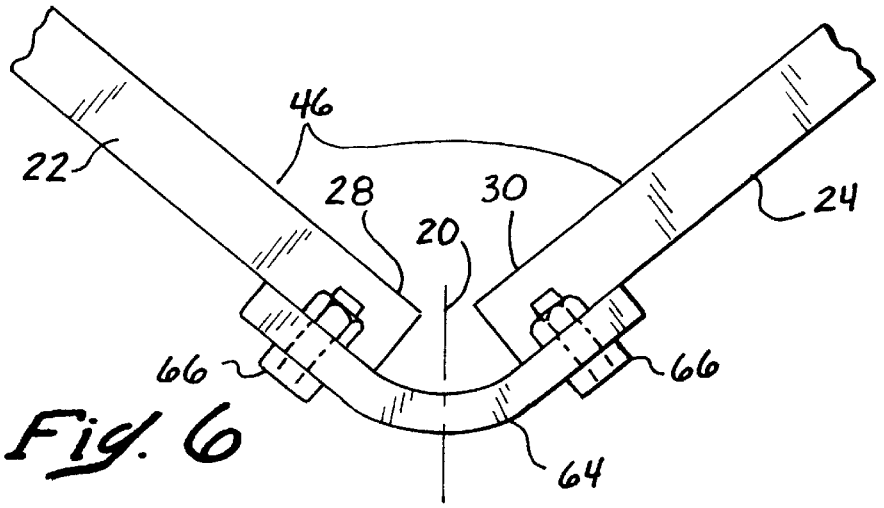
Fig. 6
Fig. 7
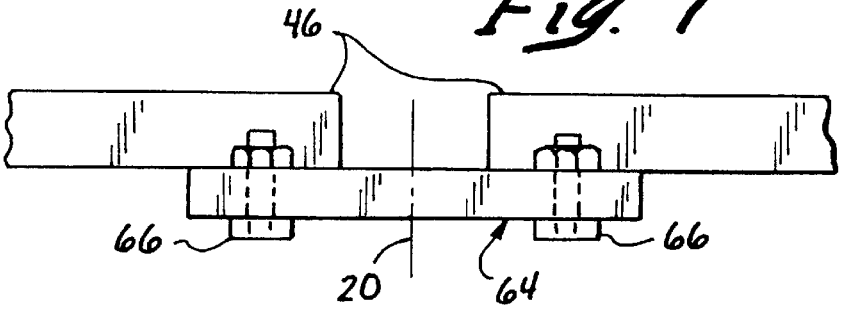

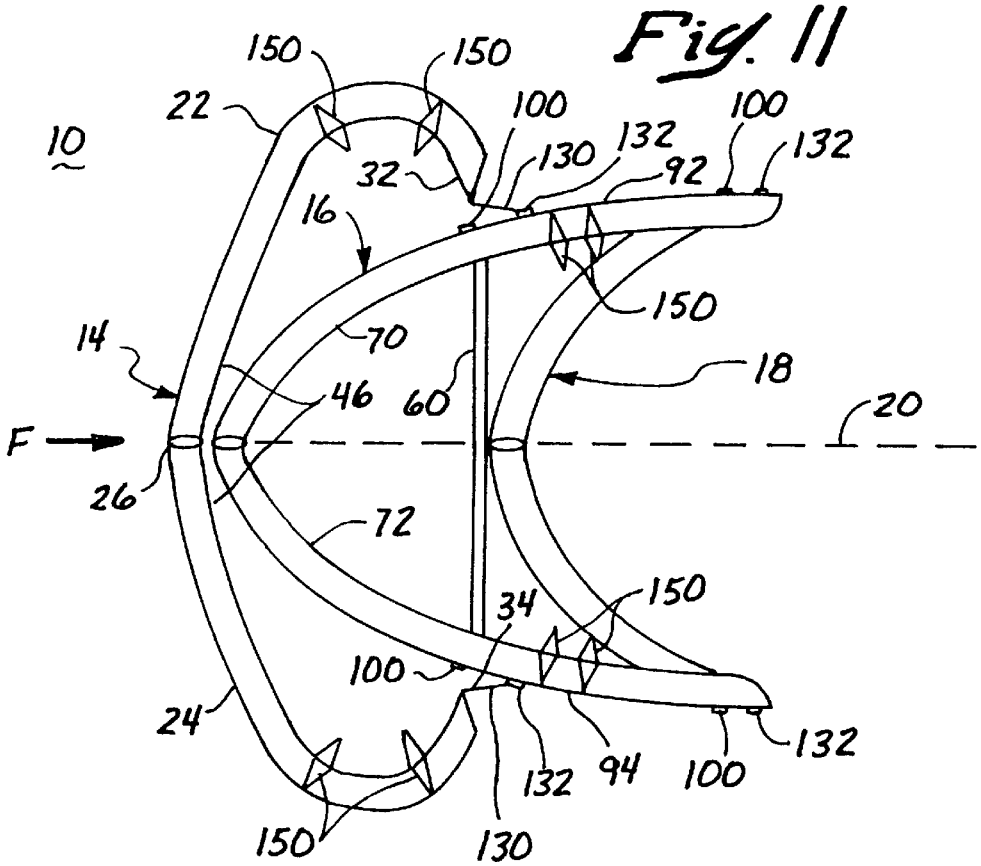
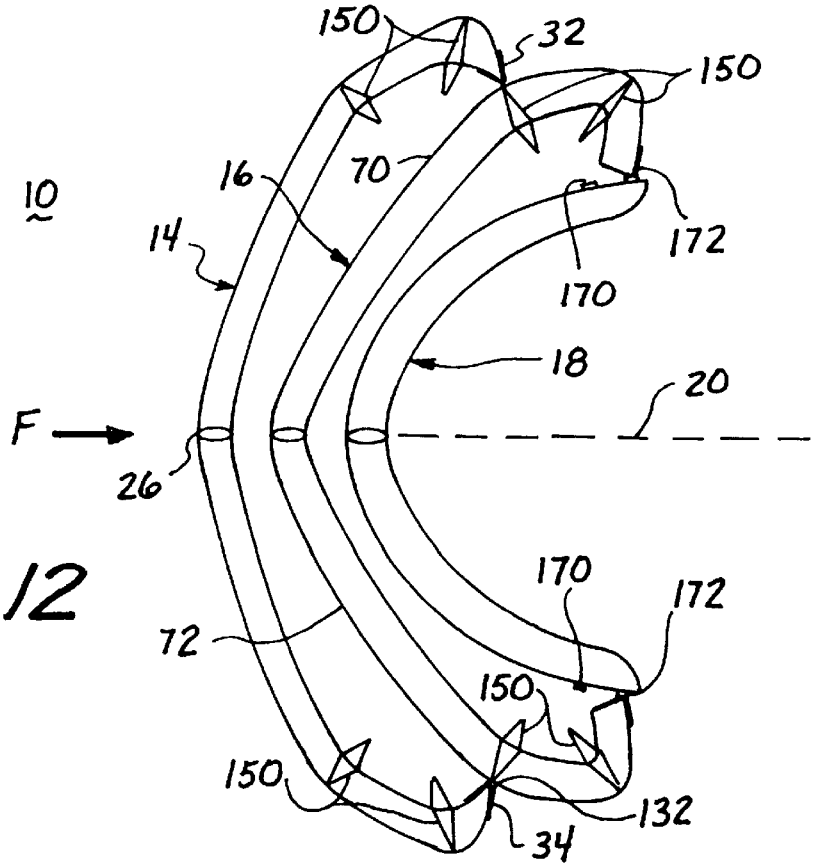
Fig. 12

CRASH ATTENUATOR OF COMPRESSIBLE SECTIONS

CROSS REFERENCES TO RELATED APPLICATIONS

This application claims the benefit of U.S. Provisional Application Ser. No. 60/045588, filed May 5, 1997. This application is related to Patent Application entitled Crash Attenuator with a Row of Compressible Hoops, filed May 5, 1998.

BACKGROUND OF THE INVENTION

1. Field of the Invention

This invention relates to an improved crash attenuator for protecting a vehicle from impacting a rigid backup. More specifically, this invention relates to an improved crash attenuator that redirects or gates and redirects vehicles.

2. Description of the Related Art

Impact attenuation devices are often used to prevent the vehicles from impacting a rigid backup. A rigid backup may be any relatively inflexible item, stationary or portable, that would be undesirable to impact. An example of a rigid backup is a toll booth median between two lanes of traffic.

Impact attenuation devices perform gating functions, redirecting functions or both. The gating function absorbs impact energy through a vehicle penetrating the gating device or portion of the attenuator. Vehicles traveling toward the rigid backup in the axial direction of the attenuator impact the gating device or portion and slow down through the length of the device. However, vehicles approaching the "coffin corner" of the rigid backup from an angle off of the axial direction of the attenuator do not have full length of the gating device or portion to absorb impact energy. The coffin corners are the front corners of the rigid backup. Without the impact energy being absorbed, the full force of the vehicle impacts the coffin corner, resulting in catastrophic damage.

To inhibit vehicles impacting the coffin corner of a rigid backup, a redirecting device or portion redirects the vehicle away from the coffin corner. To accomplish this, the redirecting device or portion must be designed to withstand lateral impact.

One approach to such impact attenuation devices employ an axially collapsible frame having compression resistant elements disposed one behind the other in the frame. Young U.S. Pat. No. 3,674,115 provides an early example of one such system. This system includes a frame made up of an axially oriented array of segments, each having a diaphragm extending transverse to the axial direction and a pair of side panels positioned to extend rearwardly from the diaphragm. Energy absorbing elements (in this example water filled flexible cylindrical elements) are mounted between the diaphragms. During an axial impact the diaphragms deform the energy absorbing elements, thereby causing water to be accelerated to absorb the kinetic energy of the impacting vehicle. Axially oriented cables are positioned on each side of the diaphragms to maintain the diaphragms in axial alignment during an impact.

Other examples of such crash barriers are shown in Walker U.S. Pat. No. 3,944,187 and Walker U.S. Pat. No. 3,982,734. These systems also include a collapsible frame made up of an axially oriented array of diaphragms with side panels mounted to the diaphragms to slide over one another during an axial collapse. The barriers of these patents use a cast or molded body of vermiculite or similar material or alternately loosely associated vermiculite particles to perform the energy absorption function. Obliquely oriented cables are provided between the diaphragms and ground anchors to maintain the diaphragms in axial alignment during a lateral impact.

Gertz U.S. Pat. No. 4,352,484 discloses an improved crash barrier that utilizes an energy absorbing cartridge made up of foam filled hexagonal lattices arranged to shear into one another in response to the compression forces applied to the energy absorbing cartridge by an impacting vehicle.

Stevens U.S. Pat. No. 4,452,431 shows yet another collapsible crash barrier employing diaphragms and side panels generally similar to those described above. This system also uses axially oriented cables to maintain the diaphragms in axial alignment, as well as breakaway cables secured between the front diaphragm and the ground anchor. These breakaway cables are provided with shear pins designed to fail during an axial impact to allow the frame to collapse. The disclosed crash barrier is used with various types of liquid containing and dry energy absorbing elements.

VanSchie U.S. Pat. No. 4,399,980 discloses another similar crash barrier which employs cylindrical tubes oriented axially between adjacent diaphragms. The energy required to deform these tubes during an axial collapse provides a force tending to decelerate the impacting vehicle. Cross-braces are used to stiffen the frame against lateral impacts, and a guide is provided for the front of the frame to prevent the front of the frame from moving laterally when the frame is struck in a glancing impact by an impacting vehicle.

All of these prior art systems are designed to absorb the kinetic energy of the impacting vehicle by compressively deforming an energy absorbing structure. Because of the potential instability of compressive deformation, these systems use structural members to resist side forces that develop from compression loading. Furthermore, all use sliding side panels designed to telescope past one another during an impact. Because such sliding side panels must slide past one another during an axial impact, they have a limited strength in compression. This can be a disadvantage in some applications.

Another prior art system known as the Dragnet System places a net or other restraining structure transversely across a roadway to be blocked. The two ends of the net are connected to respective metal ribbons, and these metal ribbons pass through rollers that bend the ribbons as they pay out through the rollers during a vehicle impact. The energy required to deform these ribbons results in a kinetic energy dissipating force which decelerates the impacting vehicle. The general principle of operation of the metal deforming rollers is shown for example in Jackson U.S. Pat. Nos. 3,211,620 and 3,377,044 as well as Vanzelm U.S. Pat. No. 3,307,832. The Dragnet System utilizes the metal ribbons in tension, but it is not well suited for use alongside a roadway because metal bending systems are positioned on both sides of the roadway, and the net or other obstruction extends completely across the roadway.

Krage U.S. Pat. No. 4,784,515 describes a collapsible guard rail end terminal that utilizes a wire cable extending through grommets in legs of the end terminal. The side panels of the end terminal are mounted to slide over one another when struck axially. When the end terminal collapses during an impact, the legs may be rotated such that the grommets work the cable and create a frictional force on the cable. However, the magnitude of the resulting retarding forces is highly variable, due to the variable and unpredictable rotational positions of the legs during the collapse.

An Advanced Dynamic Impact Extension Module (ADIEM)—11 of Syros, Inc. provides a system with both gating and redirecting portions. An initial gating section comprises a row of lightweight crushable concrete modules that are placed on a ramp increasing in height toward a rigid backup. The gating portion of the attenuator is the row of modules. A vehicle impacting the modules has the impact force absorbed as the modules break apart. Vehicles approaching more from the side are redirected by the ramp. While the ramp prevents the vehicle from impact the coffin corner, the redirecting ramp is very unforgiving in that it does not absorb energy.

Thus, a need exists for a simple, inexpensive attenuation system that absorbs energy as it redirects vehicles away from the coffin corners. A need also exists for a simple, inexpensive system that performs both gating and redirecting functions.

SUMMARY OF THE INVENTION

According to the present invention, an energy absorbing guardrail crash attenuator system comprises a row of two or more compressible sections comprising left and right curved, metal side panels. The row of compressible sections extends in an axial direction from a front end and terminates in a back end that is engagable with a rigid backup. When the attenuator is impacted by a vehicle in the axial direction, the compressible sections bend outwardly and absorb energy. When the attenuator is impacted in a direction that is off of the axial direction, the row redirects the vehicle so as not to hit the "coffin corner" of the rigid backup.

In an aspect of the invention, left and right side panel front ends of each compressible section are flexibly joined with front joints. Further, the left and right side panel back ends are attached with hinge joints to exterior surfaces of rearwardly adjacent left and right side panels, respectively. In an aspect of the invention, the hinge joints comprise one or more tabs, pull through bolt assemblies, and standard nut and bolt assemblies. The tabs extend from each side panel back end and away from the row front end. The tabs have a first portion proximate to the back end and a second portion distal to the back end. The pull-through bolt assemblies attach the tab first portions to the exterior surfaces of rearwardly adjacent left and right side panels. The standard nut and bolt assemblies attach the tab second portions to the exterior surfaces of rearwardly adjacent left and right side panels. With this attachment arrangement of the tabs, when the sections axially compress, the pull-through bolt assemblies pull through the tab first sections as the side panels back ends pivot out from the exterior surfaces of rearwardly adjacent left and right side panels.

Aspects of the invention have panel bending modifications for facilitating the axial compression of the sections. The modifications may be one or more holes extending through one or more of the side panels of the sections. Other aspects of the invention may have one or more embossed vertical ribs extending from interior surfaces of one or more of the side panels. Further, the embossed vertical ribs may have horizontal slots.

Aspects of the invention use an axial movement guide to restrict lateral movement of the row of compressible sections.

An aspect of the invention has a gating device for controlled penetration by a vehicle. The gating device has a first portion into which the row front extends and a second portion that extends from the first portion and away from the row of hoops along the row axis. The gating device may be an array of containers holding particulate mass, such as sand barrels. The row of hoops may also have a pointed nose that extends from the row front.

In an aspect of the invention, the compressible sections w-beam guardrails or thrie-beam guardrails. Further, the sides of the rigid backup complement the metal side panels, providing structural support.

BRIEF DESCRIPTION OF THE DRAWINGS

FIG. 5 shows an elevational view of a flexible joint used in an embodiment of the invention to flexibly join the ends of the curved panels shown in FIG. 1;

FIGS. 6 and 7 show top views of the flexible joint shown in FIG. 5 in different positions;

FIG. 11 shows the attenuator shown in FIG. 1 after the initial section has been compressed;

FIG. 12 shows the attenuator shown in FIG. 11 after the intermediate section has been compressed;

DETAILED DESCRIPTION OF THE PREFERRED EMBODIMENTS

Figure 1:
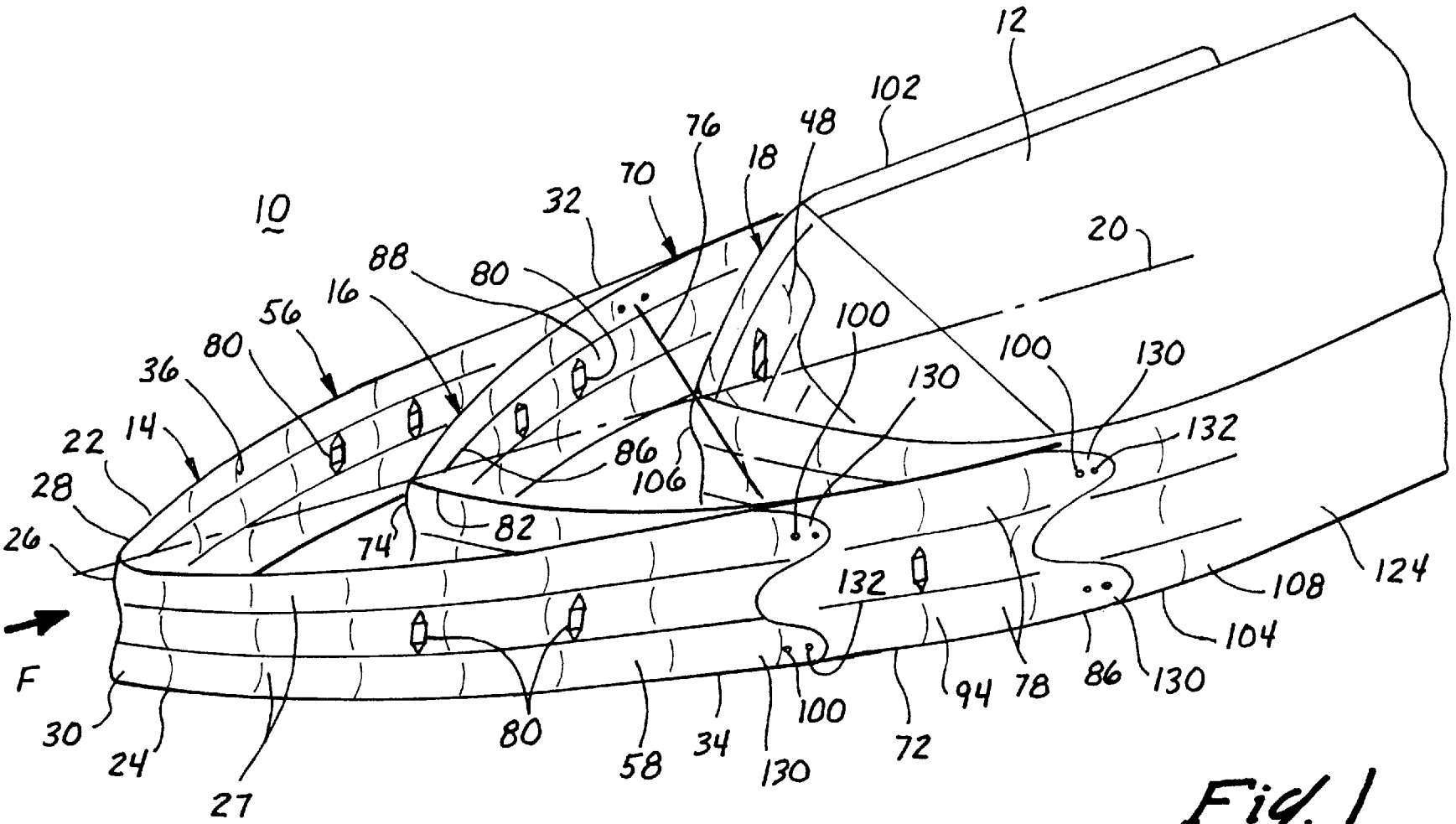
FIG. 1 shows a perspective view of an attenuator according to an embodiment of the invention.
Figure 2:
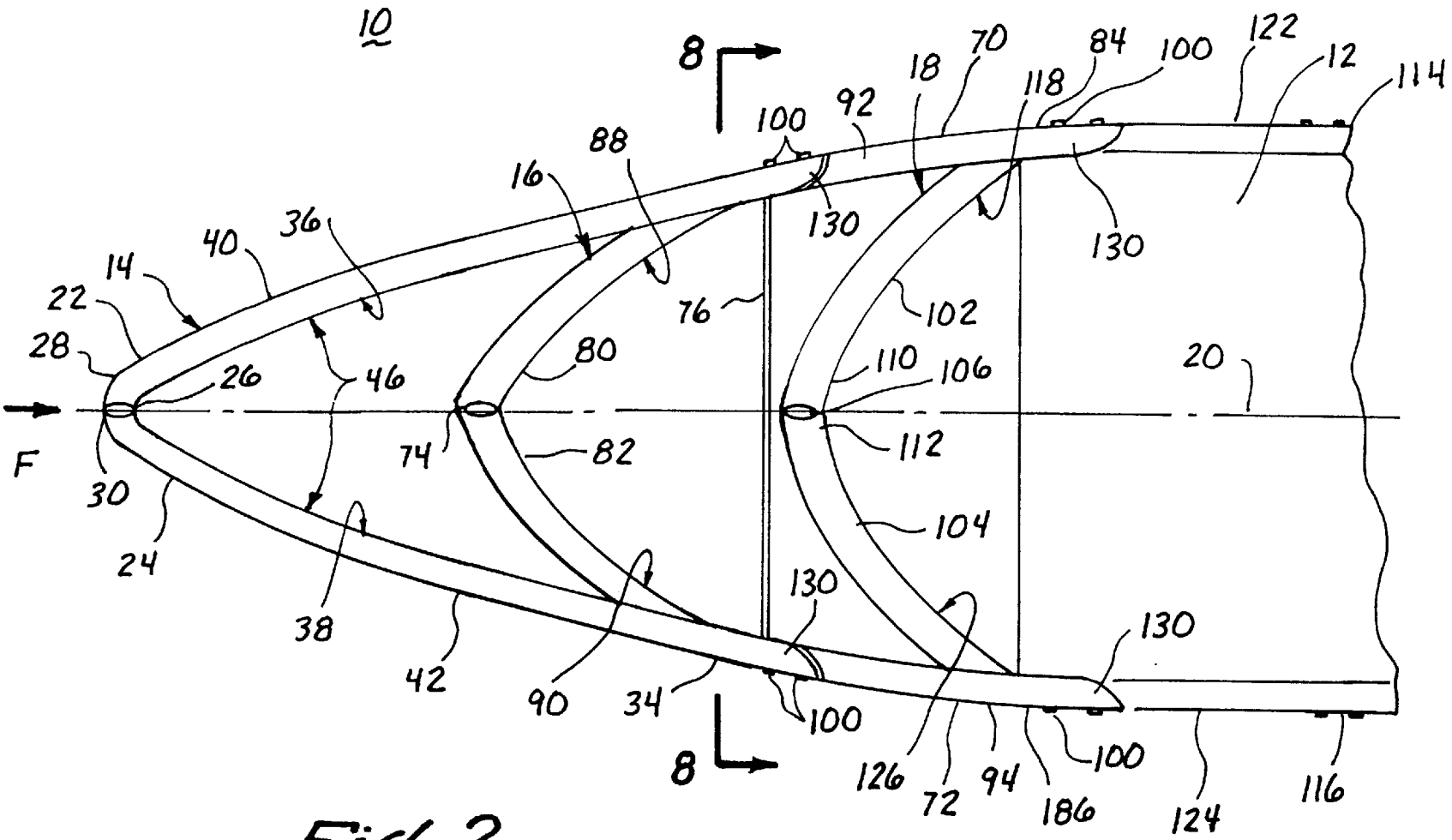
FIG. 2 shows a top view of the attenuator shown in FIG. 1.

Now referring to the figures, wherein like reference numbers refer to like elements throughout, and referring specifically to FIGS. 1 and 2, an energy absorbing guardrail crash attenuator 10 is mounted to a rigid backup 12. The rigid backup 12 may be a median used to channel traffic, such as in front of a toll booth and the like. The attenuator 10 absorbs energy during impact by a vehicle, thereby decreasing the damage that may occur to the vehicle, passengers, and rigid backup 12 from the impact.

The attenuator 10 is comprised of an initial section 14, an intermediate section 16, and a terminal section 18. The initial section 14 is shown forwardly positioned and the terminal section 18 is shown rearwardly positioned. In the shown embodiment of the invention, each of the sections 14, 16 and 18 compress, and absorb energy, when a force F is directed along the horizontal axis 20 of the attenuator 10. Embodiments of the invention may have more than one intermediate section 16, no intermediate sections, or have only an initial section 14 attached directly to the rigid backup 12. Embodiments of the invention may have non-compressible sections.

The initial section 14 is comprised of two initial section side panels 22 and 24, and a joint 26. The side panels 22 and 24 are approximately the same length and extend horizontally. The side panels 22 and 24 are shown to have horizontal corrugations 27 as they are formed from a W-beam. Other embodiments of the invention may have other corrugation configurations or may be flat. The side panels 22 and 24 have front ends 28 and 30 that are disposed distally to the rigid backup 12 and back ends 32 and 34 that are disposed proximately to the rigid backup 12. The side panels 22 and 24 have interior surfaces 36 and 38 oriented toward the axis 20 and exterior surfaces 40 and 42 oriented away from the axis.

Figure 4:
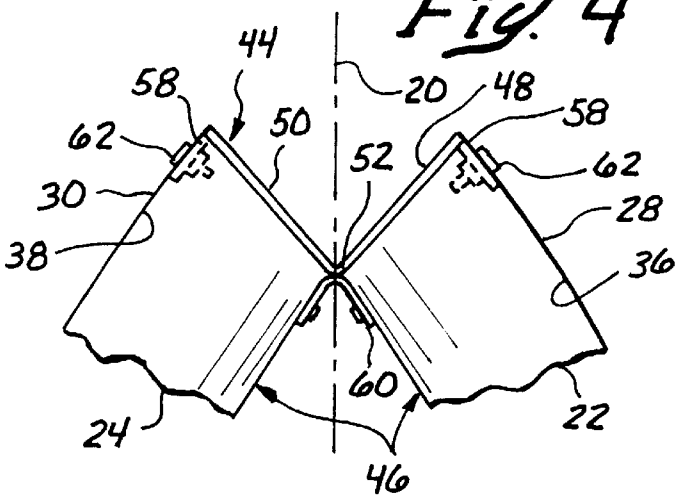
FIG. 4 shows a top view of the weldament shown in FIG. 3.
Figure 3:
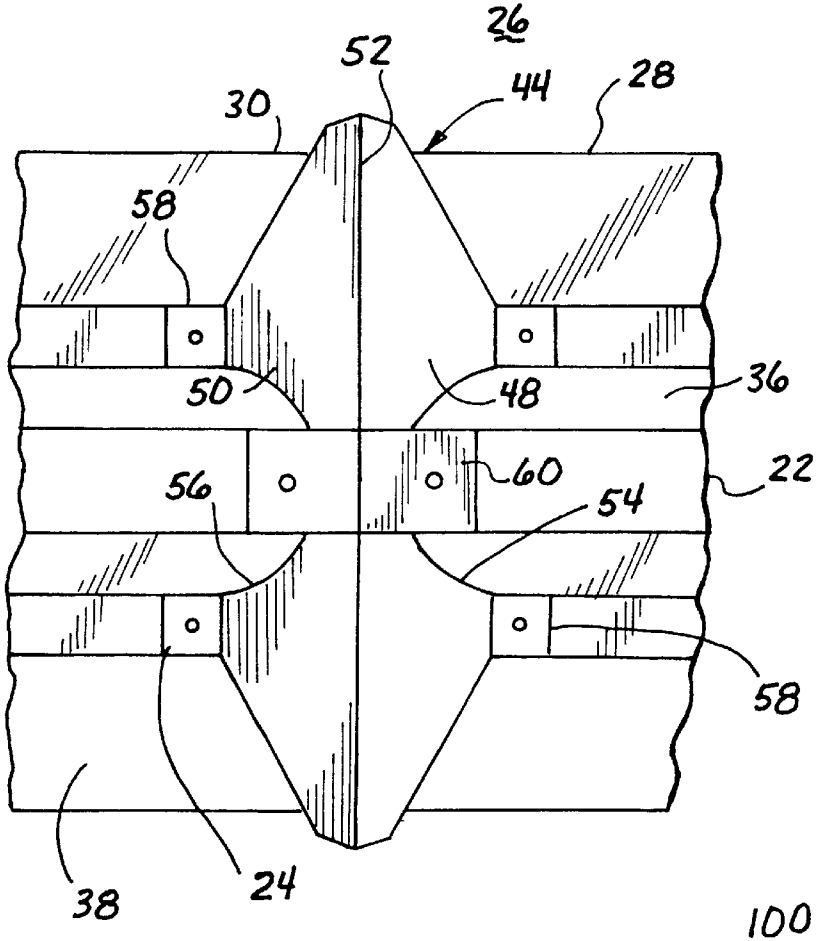
FIG. 3 shows an elevational view of a weldament used in an embodiment of the invention to flexibly join the ends of the curved panels shown in FIG. 1.

Referring now to FIGS. 3 and 4, in an embodiment of the invention, the initial section joint 26 is formed by a weldament 44 that flexibly attaches the front ends 28 and 30. The attached front ends 28 and 30 form an interior angle 46 that is generally bisected by the axis 20. The weldament 44 is comprised of two vertical panels 48 and 50 that meet at a vertical corner 52. The panels 48 and 50 have shaped, vertical outer edges 54 and 56 that complement the interior surfaces 36 and 38 of the side panels. The vertical panels 48 and 50 are attached to the side panels 22 and 24 by side tabs 58 and center tab 60. The side tabs 52 extend from the edges 54 and 56, are disposed against the interior surfaces 36 and 38, and attach to the side panels 22 and 24 via bolts 62. Embodiments of the invention may have welds or other attachment means for attaching the side tabs 58 to the side panels 22 and 24. The center tab 60 extends from the corner 43 and is attached to the side panels 22 and 24 in a similar fashion as the side tabs 58.

Referring now to FIGS. 5, 6, and 7, in other embodiments of the invention, a flexible plate 64 functions as a joint. The plate 64 attaches the front ends 28 and 30 of the side panels 22 and 24. More specifically, the plate 64 is attached via bolts to the exterior surfaces 40 and 42 of the side panels 22 and 24. The plate 64 has a vertical midline 68 about which the plate bends. This bending permits the side panels to have the angle 46 change from less than 180°, as shown in FIG. 6, to 180°, as shown in FIG. 7, and beyond if desired. Referring back to FIGS. 1 and 2, the compressible intermediate section 16 is of similar construction as the initial section 14. The intermediate section 16 is comprised of two intermediate section side panels 70 and 72, a joint 74, and a cross tension member 76. The side panels 70 and 72 are of approximately the same length and extend horizontally. The side panels 70 and 72 are shown to have horizontal corrugations 78 of similar dimensions as the corrugations 27 of the initial section 14. Other embodiments of the invention may have other corrugation configurations, or may be flat panels. The side panels 70 and 72 have front ends 80 and 82 that are disposed distally to the rigid backup 12 and back ends 84 and 86 that are disposed proximately to the rigid backup 12. The side panels 70 and 72 have interior surfaces 88 and 90 oriented toward the axis 20 and exterior surfaces 92 and 94 oriented away from the axis. The joint 74 is similar to the joint 26 of the initial compressible section 14.

Figure 8:
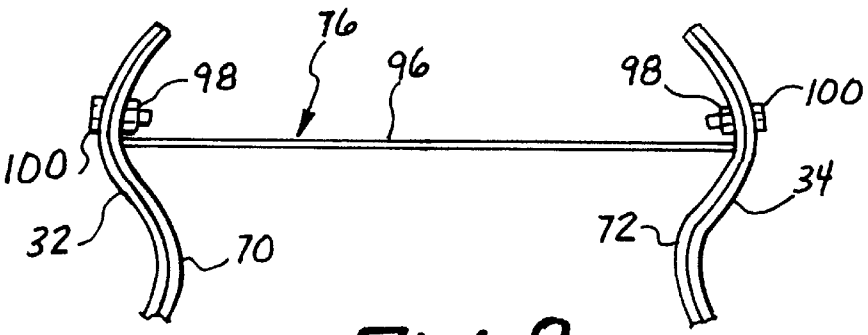
FIG. 8 shows an embodiment of a cross member used in the attenuator shown in FIG. 1.

The cross tension member 76 extends between the side panels 70 and 72. The cross tension member 76 assists in holding the back ends 84 and 86 in a predetermined distance that is the length of the member 76. The member 76 is designed to release the side panels 70 and 72 when force F is applied, thus enabling the intermediate section 16 to compress. Referring now to FIG. 8, an embodiment of the invention has the cross tension member 76 comprised of a metal strip 96 with nuts 98 attached to the ends of the strip. The nuts 98 may be attached to pull-through bolts 100 that extend through the overlapping initial section side panels 22 and 24 and intermediate section side panels 70 and 72. The pull-through bolts 100 are designed to pull through the side panels when the section compresses, as described below. Other embodiments of the invention may have regular bolts (not shown) and the metal strip breaks when the sections compress, or have a rod with threaded female ends (not shown) that is used in conjunction with either pull-through bolts 100 or regular bolts. As shown, the back ends 32 and 34 of the initial section 14 are partially bolted to the intermediate section 16 using the bolts 100 of the cross-member 76. Other embodiments of the invention may use means for attaching the two sections. Other embodiments of the invention may have cross tension members in any of the compressible sections.

The compressible terminal section 18 is of similar construction as the initial section 14 and the intermediate section 16. The terminal section 18 is comprised of two terminal section side panels 102 and 104, and a joint 106. The side panels 102 and 104 are of approximately the same length and extend horizontally. The side panels 102 and 104 are shown to have horizontal corrugations 108 as they are formed from a W-beam. Other embodiments of the invention may have other corrugation configurations. In a preferred embodiment of the invention, the corrugations 27, 78 and 108 complement each other to facilitate overlapping of the panel ends onto the rearwardly adjacent section's panels and for attenuator stability. Other embodiments of the invention may have panels with other corrugations or be flat panels.

The terminal section side panels 102 and 104 have front ends 110 and 112 that are disposed distally to the rigid backup 12 and back ends 114 and 116 that are attached to the rigid backup 12. The side panels 102 and 104 have interior surfaces 118 and 120 oriented toward the axis 20 and exterior surfaces 122 and 124 oriented away from the axis. The joint 106 is similar to joints 26 and 74. Embodiments of the invention may use an suitable joint or means for flexibly attaching the front ends the side panels for any section. In the embodiment of the invention shown, the terminal section 18 does not have a cross tension member, but other embodiments of the invention may have terminal sections with cross tension members.

The attenuator 10 is arranged such that the compression sections 16 and 18 nest in the forwardly adjacent section. More specifically, the intermediate section joint 74 is disposed between the initial section side panels 22 and 24. Additionally , the terminal section joint 106 is disposed between the intermediate section side panels 70 and 72.

The compression sections 14, 16 and 18 are attached to adjacent compression sections and, ultimately, to the rigid backup 12. Section 14 is attached to section 16, while section 16 is attached to section 18 and section 18 is attached to the rigid backup 12. The means of attachment for sections 14 and 16 comprises tabs 130 extending from the back ends 32, 34, 84, and 86. In the embodiment shown, two tabs 130 extend from the back ends. Other embodiments of the invention may have other suitable arrangements for attaching the sections to the rigid backup 12.

Figure 9:
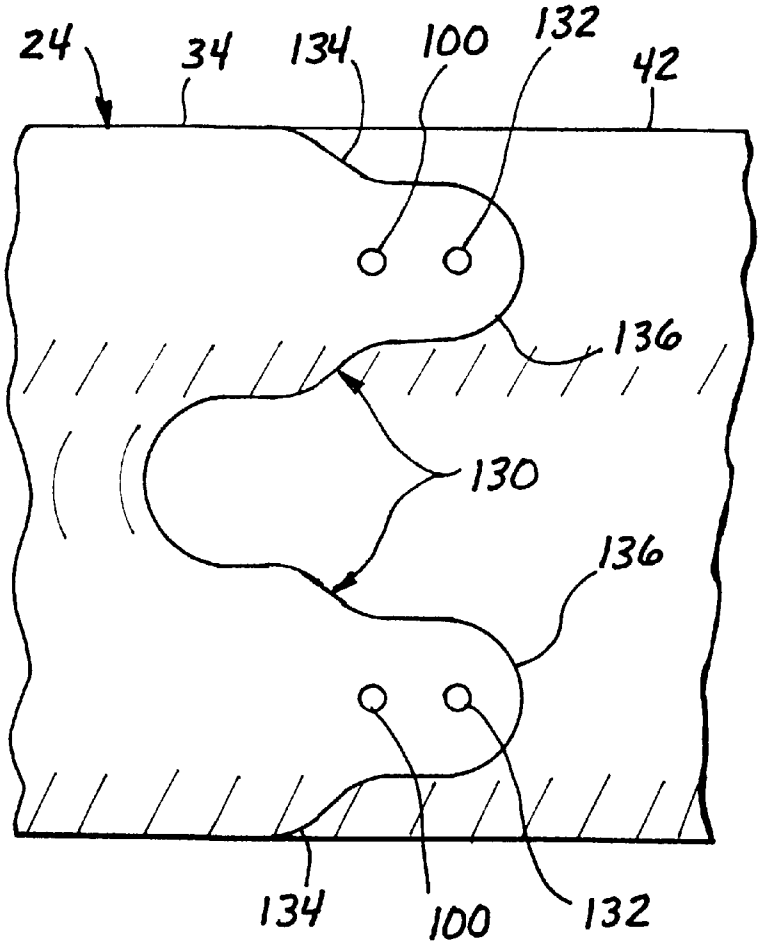
FIG. 9 shows a detail of an end of a compressible section joining a rearwardly adjacent compressible section of the attenuator shown in FIG. 1.

Referring now to FIG. 9, an example of the means of attachment for sections 14 comprises the tabs 130 from the initial section side panel 24 extending toward the rigid backup 12 (not shown) and being mounted to the exterior surface 42 of the intermediate section side panel 72. The tabs 130 are mounted via the pull-through bolts 100 and regular bolts 132. The pull-through bolts 100 extend through a first portion 134 of the tab 130 that is distal to the rigid backup 12. The regular bolts 132 extend through a second portion 136 of the tab 130 that is proximal to the rigid backup 12.

Figure 10:
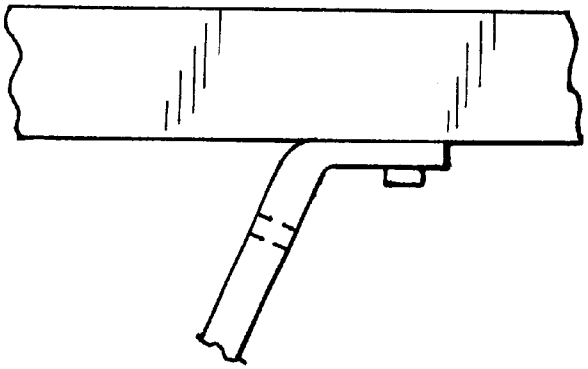
FIG. 10 shows a detail of the end of the compressible section shown in FIG. 9 after the end has hinged away from the rearwardly adjacent compressible section.

The combination of the two bolts 100 and 132 of the attachment means results in a hinge means for enabling the side panel back end 34 to pivot out from the adjacent side panel exterior surface 42, as is shown in FIG. 10. During compression of the initial section 14 of the shown embodiment, the back end 34 pivots out from the surface 42. As the pivoting occurs, the pull-through bolt 100 pulls through the tab 130 thereby enabling the tab to function like a hinge as the regular bolt 132 keeps of the second portion 136 against the exterior surface 42. Other embodiments of the invention may have other hinge means for enabling the back ends of the panels to pivot out while remaining attached to the exterior surface of the adjacent side panel. In the shown embodiment, the cross tensioning member 76 is also connected with the pull-through bolts 100. Other embodiments of the invention may have the cross tensioning members attached to the side panels via bolts, regular or pull-through, that are not attaching a tab to a side panel. Embodiments of the invention may not have hinge means for pivoting the back ends of side panels away from the exterior surface of the adjacent side panels.

Now referring to FIGS. 11 and 12, the side panels 22, 24, 70, and 72 bend and absorb energy when the axially oriented force F is directed against the initial section 14 and toward the rigid backup 12. The energy is absorbed by both the initial section 14 and the intermediate section 16. Referring specifically to FIG. 11, the initial section 14 absorbs the energy and axially compresses as the initial section side panels 22 and 24 bend outward from the axis 20. During the compression, the front ends 28 and 30 of the initial section side panels 22 and 24 pivot on the joint 26 and the angle 46 opens up. As the panels 22 and 24 bend outward, the pull-through bolts 70 pull through the tabs 130, enabling the back ends 32 and 34 to pivot out from the intermediate section exterior surfaces 92 and 94. FIG. 12 shows both the initial section 14 and the intermediate section 16 compressed, with the intermediate section bending outward in a similar manner as the initial section 14. The cross tension member 76 is not shown in FIG. 12 as the pull-through bolts 100 have pulled through the panels, resulting in the member dropping out of the attenuator 10.

In the shown embodiment, the panels 22, 24, 70 and 72 are modified to facilitate their bending in an outward direction. The convex curvature of the panels assist in the bending. However, further modifications result in not only directing the bending during compression by incorporating a weak point, but also result in designing for compression to occur at various values of force F. In the shown embodiment of the invention, the modifications are vertical ribs 150 embossed in the side panels to create points of weakness and facilitate the outward bending of the panels.

Figure 13:
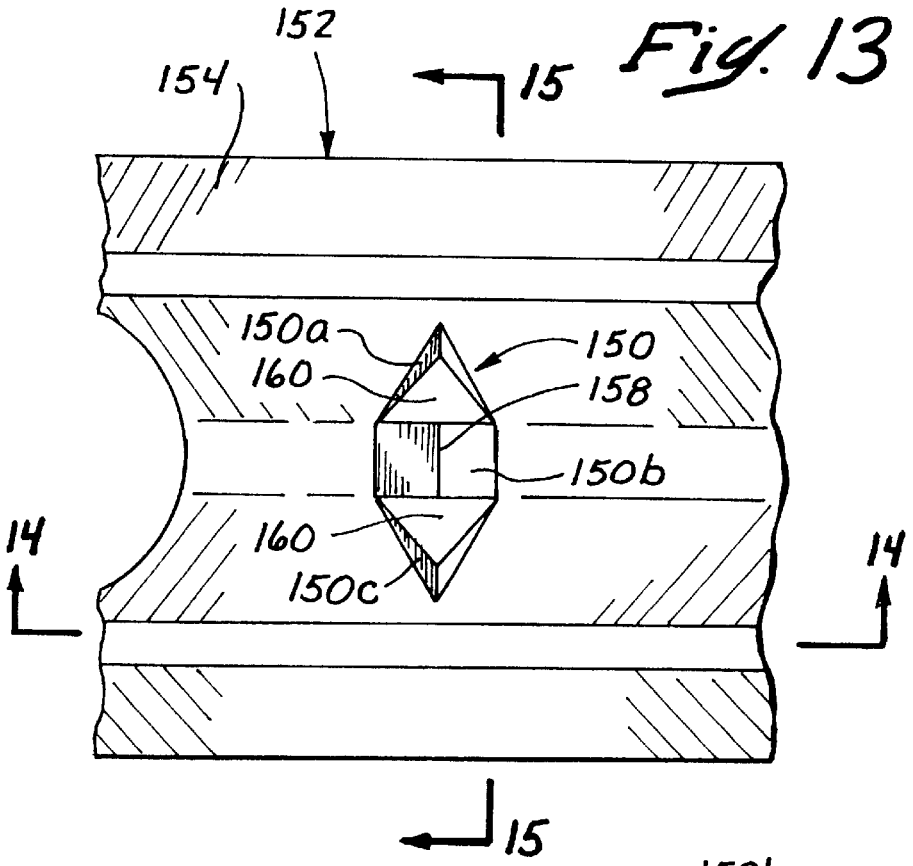
FIGS. 13, 14, and 15 show views of an embossed rib used to facilitate bending of the panels of the attenuator shown in FIG. 1.
Figure 14:
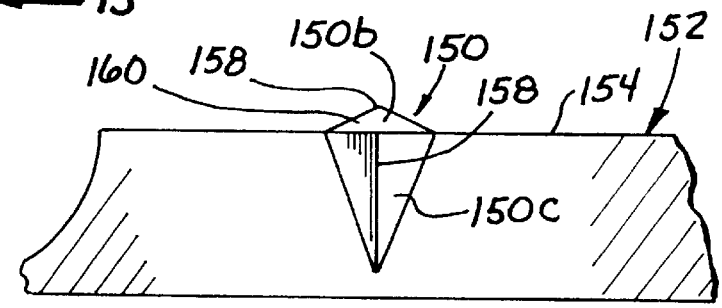
Figure 15:
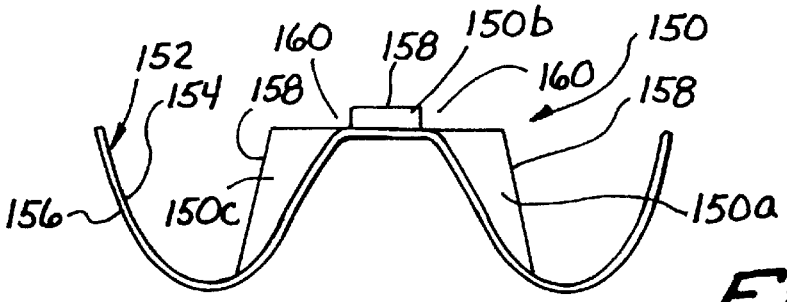

Referring now to FIGS. 13, 14, and 15, details of a typical vertical rib 150 before panel bending are shown. The vertical rib 150 is embossed on a typical side panel 152 such that it extends from an interior surface 154 toward the axis 20 (not shown). The typical side panel 154 also has an exterior surface 156. The rib 150 has a vertical crease 158 running down its middle. The rib 150 also has two horizontal slots 160, dividing the rib into three sections 150*a–c*. Other embodiments of the invention may have more or less horizontal slots 160.

Figure 16:
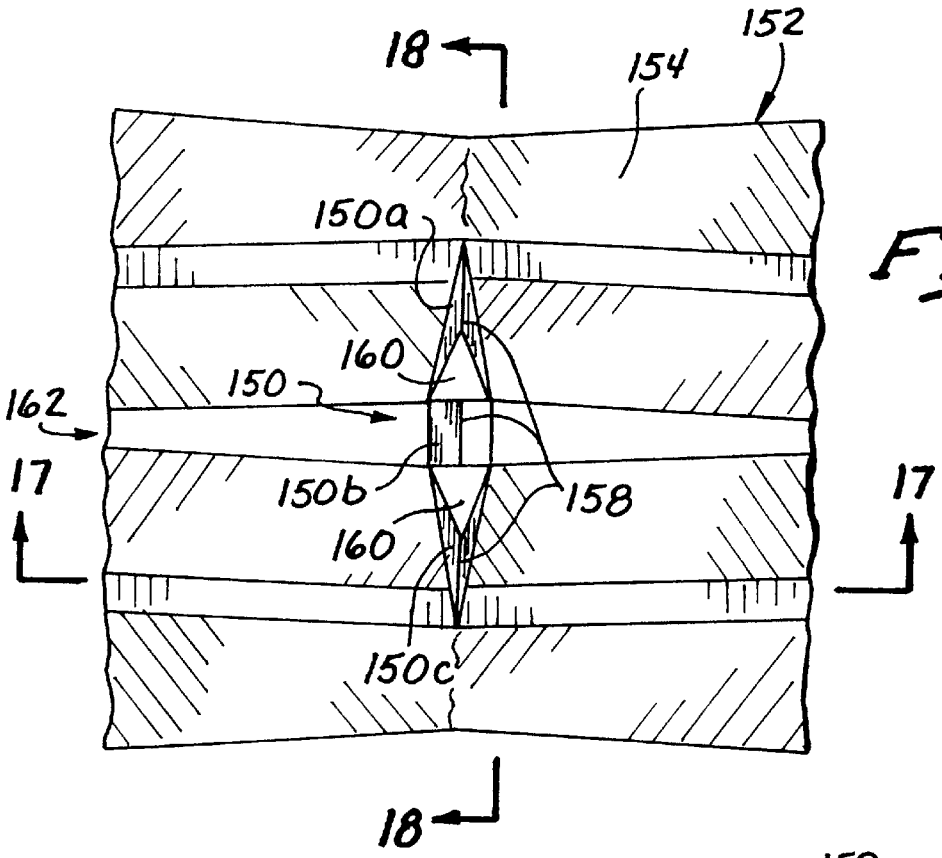
FIGS. 16, 17, and 18 show views of the embossed rib shown in FIGS. 13, 14, and 15 after the bending of the panel.
Figure 17:
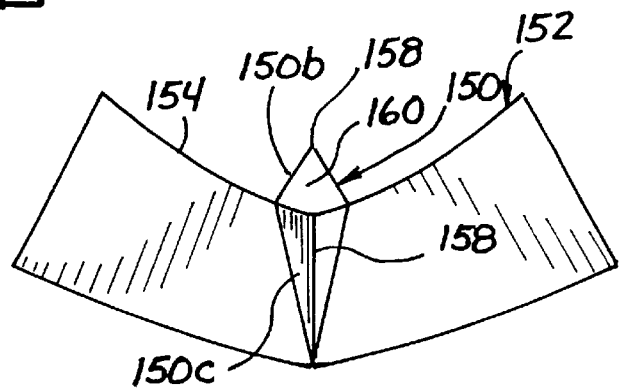
Figure 18:
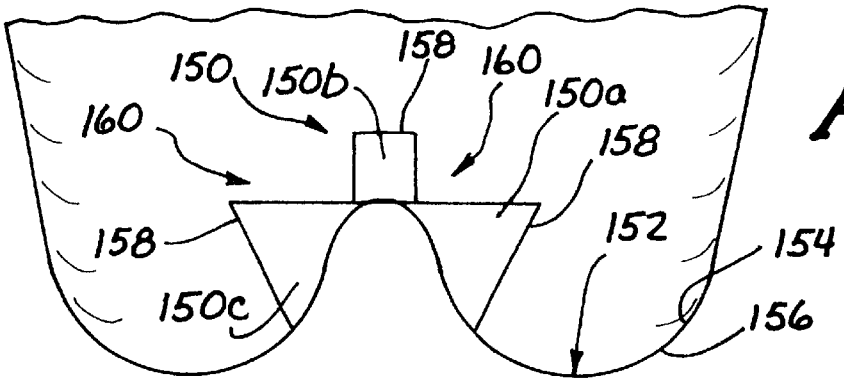

Referring now to FIGS. 16, 17, and 18, details of the rib 150 after panel bending are shown. The rib 150, due to the crease 158 and the horizontal slots 160, is a weakness in the panel 152. When the force F is applied (see FIG. 1), the panel 152 bends outward at this weakness. FIG. 16 shows the panel 152 bending into the figure. FIG. 17 shows the panel 154 bending downward. The bending causes the rib 150 to narrow, resulting in the three sections 150*a–c* protruding further from the interior surface 154. The horizontal slots 160 also open further. Other embodiments of the invention may have other modifications to the panels to create a weakness in the panel and facilitate bending, such as ribs of other configurations, a hole 160 extending through the side panels (see FIGS. 13 and 16), and the like. Embodiments of the invention may not have modifications to the side panels to facilitate bending.

Figure 19:
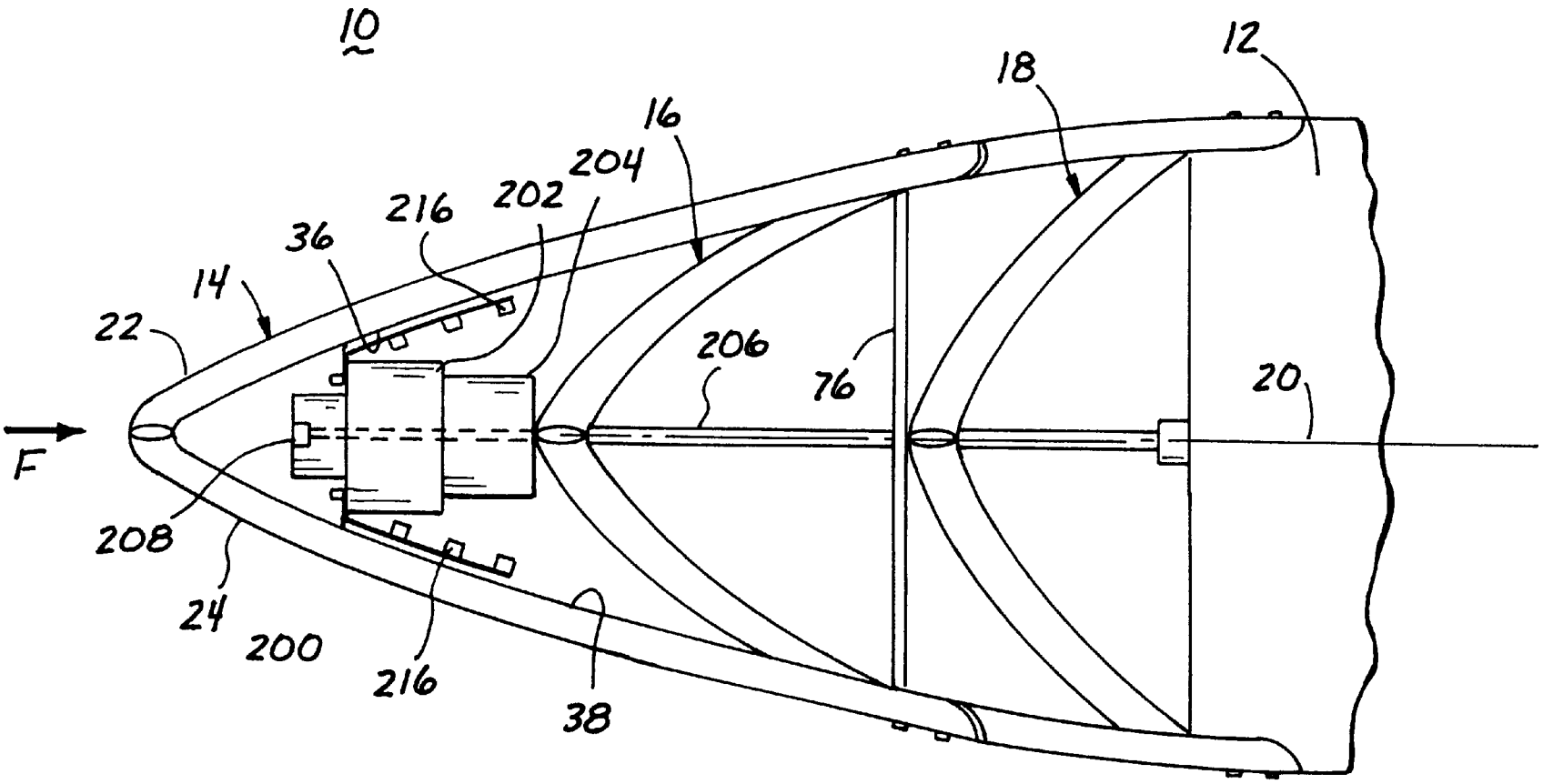
FIG. 19 shows the attenuator shown in FIG. 1 with an axial movement guide disposed in the attenuator's initial section.
Figure 20:
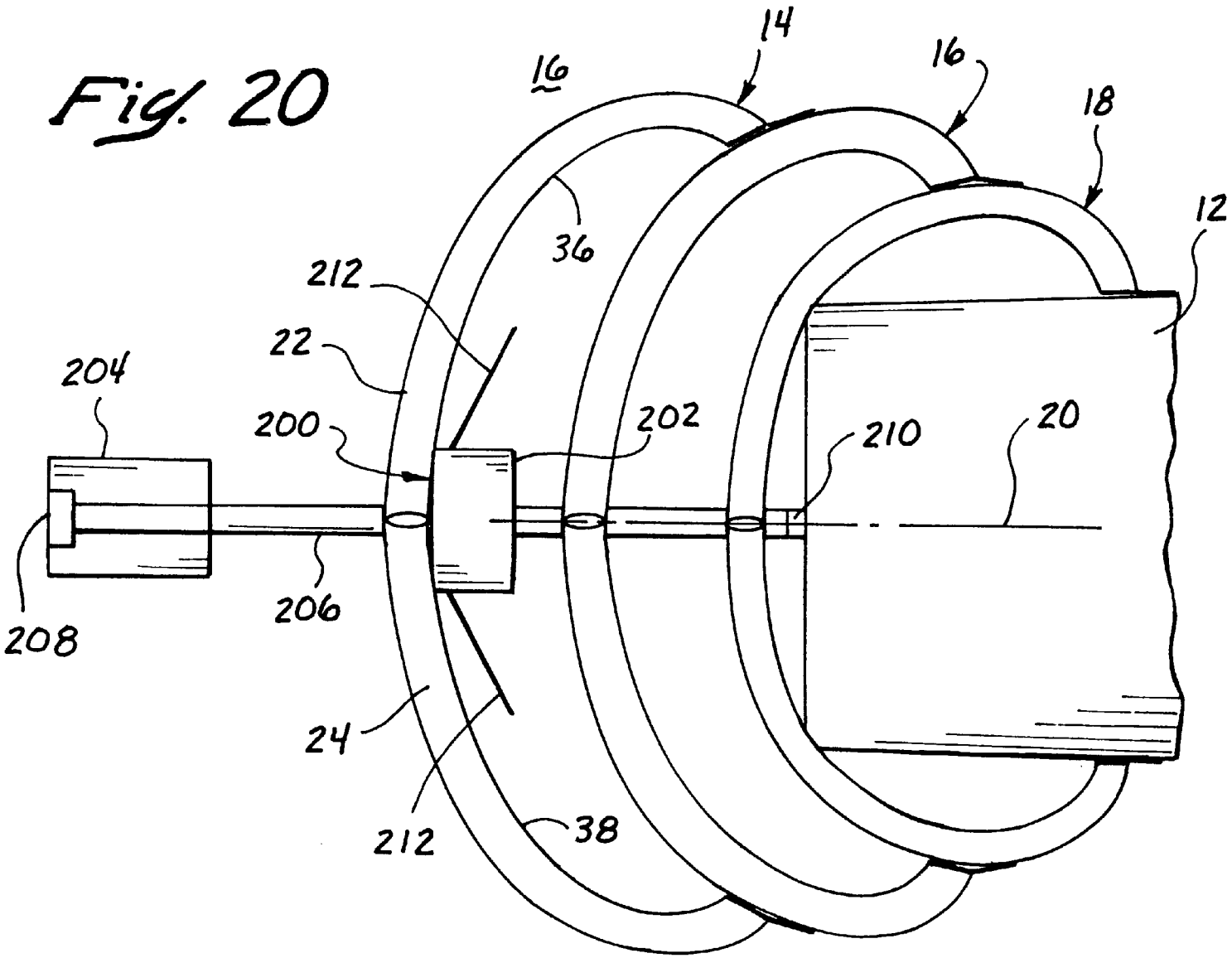
FIG. 20 shows the attenuator shown in FIG. 19 after compression.

Referring to FIGS. 19 and 20, an embodiment of the invention is shown with an axial movement guide 200 mounted in between the side panels 22 and 24 of the initial section 14. The guide 200 is comprised of an upper structure 202, a plate 204, and a cable 206. The upper structure 202 is slidably mounted to the plate 204 that enables the upper structure to move axially toward the rigid backup 12 when force F is applied to the attenuator 10. The plate 204 is mounted to the surface below the attenuator 10. The cable 206 is stretched along the axis 20 extending from a cable connector 208 on the plate 204 to the cable connector 210 on the rigid backup 12. The cable 206 guides the upper structure 202 during section compression.

Referring specifically to FIG. 19, the axial movement guide upper structure 202 is shown connected to the interior surfaces 36 and 38 of the initial structure side panels 22 and 24. Mounting members 212 extend from the sides 214 of the upper structure 202 and are bolted to the interior surfaces 36 and 38 using pull-through bolts 216. During compression, the bolts 216 pull through the side panels 22 and 24, resulting in the unattached mounting members 212 shown in FIG. 20. Other embodiments may have other suitable arrangements for connecting the members 212 to the side panels 22 and 24, or may have other suitable arrangements for connecting the upper structure 202 to the initial section 14. Still further embodiments of the invention may have the axial movement guide 200 not connected to the initial section. Still further embodiments of the invention may have the initial section 14 be rigid and not compress while force F is applied. Still further embodiments of the invention may have the axial movement guide 200 in front of the initial section 12 or connected to any other section, whether compressible or non-compressible.

Figure 21:
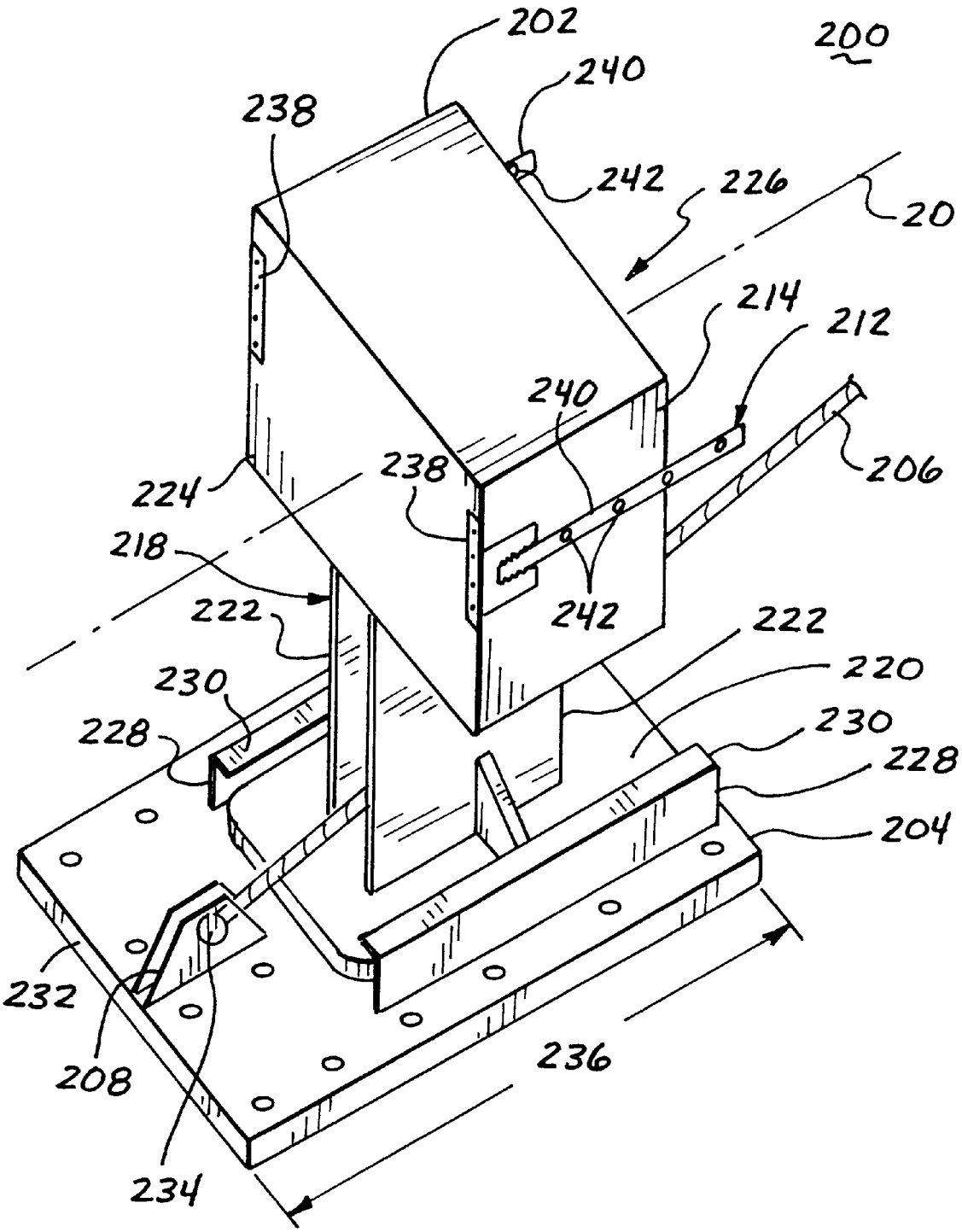
FIG. 21 shows a perspective view of the axial movement guide of the attenuator shown FIG. 19.

Referring now to FIG. 21, the axial movement guide 200 is shown comprising the upper structure 202, the plate 204, the cable 206, the cable connector 208, and the mounting members 212. A cable guide 218 descends from the upper structure 202 and terminates at a base 220. The cable guide 218 comprises two vertical panels 222 that are axially oriented and extend from the upper structure front surface 224 to the upper structure back surface 226. The vertical panels 222 straddle the cable 206. The length 236 of the plate 204 varies with embodiments. The base 220 rests on the plate 204 between two base guides 228. The guides 228 prevent the upper structure 202 from moving laterally. The guides 228 have top lips 230 that over hang the base 220 to prevent the upper structure 202 from tipping over when a lateral force is applied. The cable connector 208 is mounted to the plate front 232 and extends in vertical and axial directions. The cable 206 extends through a hole 234 in the connector 208. The mounting members 212 comprise a front lip 238 that is attached to the upper structure front 224. An axial member 240 of the mounting member 212 extends backward from the front lip 238. The member 240 has holes 242 extending therethrough for mounting to the side panels 22 and 24 of the initial section 14 via bolts 216 (see FIG. 19). Embodiments of the invention may have other axial movement guides 200 for guiding the initial section 14 axially toward the rigid backup 12 when force F is applied to the attenuator 10.

Figure 22:
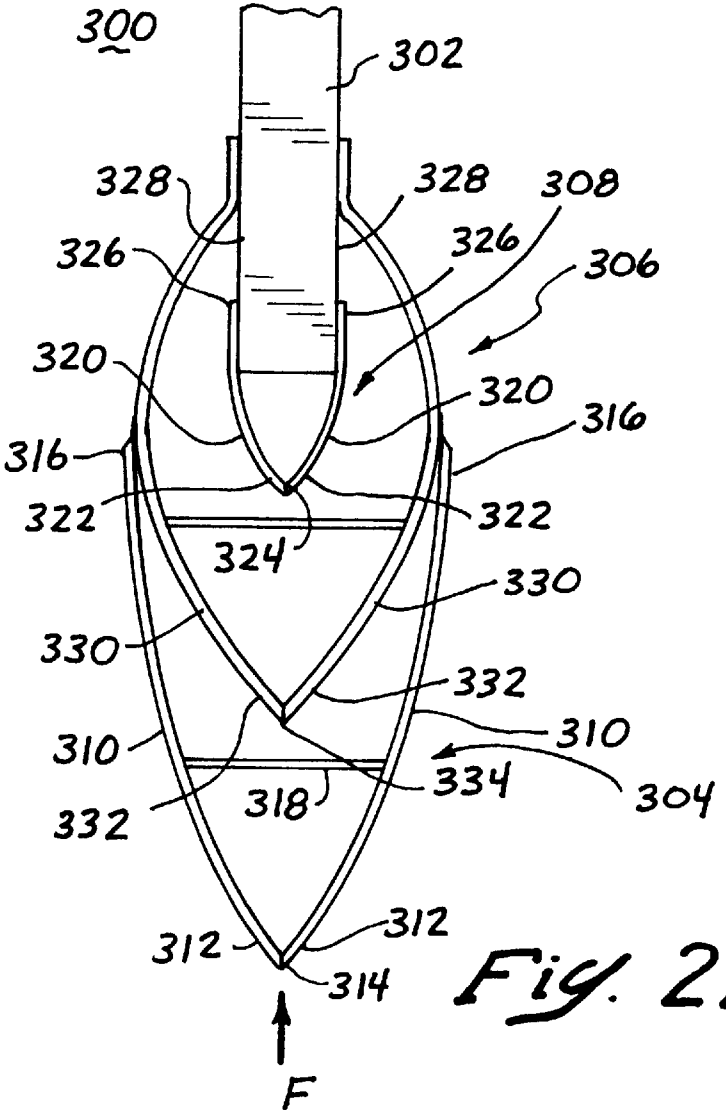
FIG. 22 shows an attenuator according to an embodiment of the invention.

Attenuator 10 is preferably used with a rigid backup 12 of three to nine feet wide. Referring now to FIG. 22, an attenuator 300 is preferably used with a rigid backup 302 of three to six feet wide. The attenuator 300 is comprised of an initial section 304, an intermediate section 306, and a terminal section 308. The initial section 304 is distal to the rigid backup 302 and the terminal section 308 is proximal to the rigid backup, with the intermediate section 306 being between the other two sections.

The initial section 304 is arranged similarly to initial section 14 of the attenuator 10. The initial section 304 is comprised of two side panels 310 that have front ends 312 that are joined via a flexible joint 314. The back ends 316 of the side panels 310 are attached to the intermediate section 306 in a similar manner as the attenuator 10 initial section side panels back ends 32 and 34 are attached to the attenuator 10 intermediate section. The initial section 304 further comprises a cross-section member 318 extending between the side panels 310 that is similar to the cross-section member 76. Other embodiments of the invention may not have a cross-section member in the initial section 304.

The terminal section 308 is arranged similarly to the terminal section 18 of the attenuator 10. The terminal section 308 is comprised of two side panels 320 that have front ends 322 that are joined via a flexible joint 324. The back ends 326 of the side panels 320 are attached to the sides 328 of the rigid backup 302. The shown embodiment does not have a cross-section member, but other embodiments of the invention may have a cross-section member.

The intermediate section 306 has side panels 330 that extend backward further than the attenuator 10 intermediate section side panels 70 and 72. The side panels 330 have front ends 332 that are joined via a flexible joint 334. A cross-member cross-section member 336 extends between the side panels 330. Other embodiments of the invention may not have a cross-section member in the intermediate section 306. As with attenuator 10, the intermediate section joint 334 is between the initial section side panels 310. Likewise, the terminal section joint 324 is between the intermediate section side panels 330.

Figure 23:
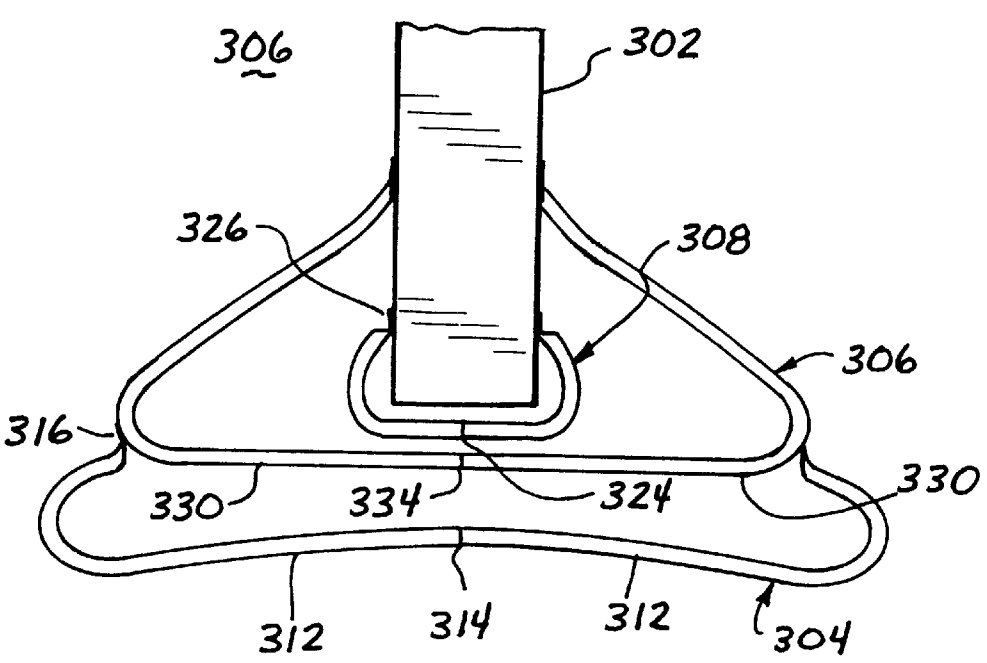
FIG. 23 shows the attenuator shown in FIG. 22 after compression.

The intermediate side panels 330 curve around the terminal section 308 and are attached to the rigid backup 302 behind the terminal section. By doing so, the side panels 330 form a hoop. The additionally curved side panels 330 facilitate bending and absorbing the energy of the force F. Referring now to FIG. 23, the attenuator is shown after compression of sections 304, 306, and 308.

Embodiments of the invention for attenuator 300 may encompass any of the variations of attaching the side panels, the joints, connecting the cross-section members, having modifications to bend the panels, and employing an axial movement guide as described in connection with attenuator 10.

Figure 24:
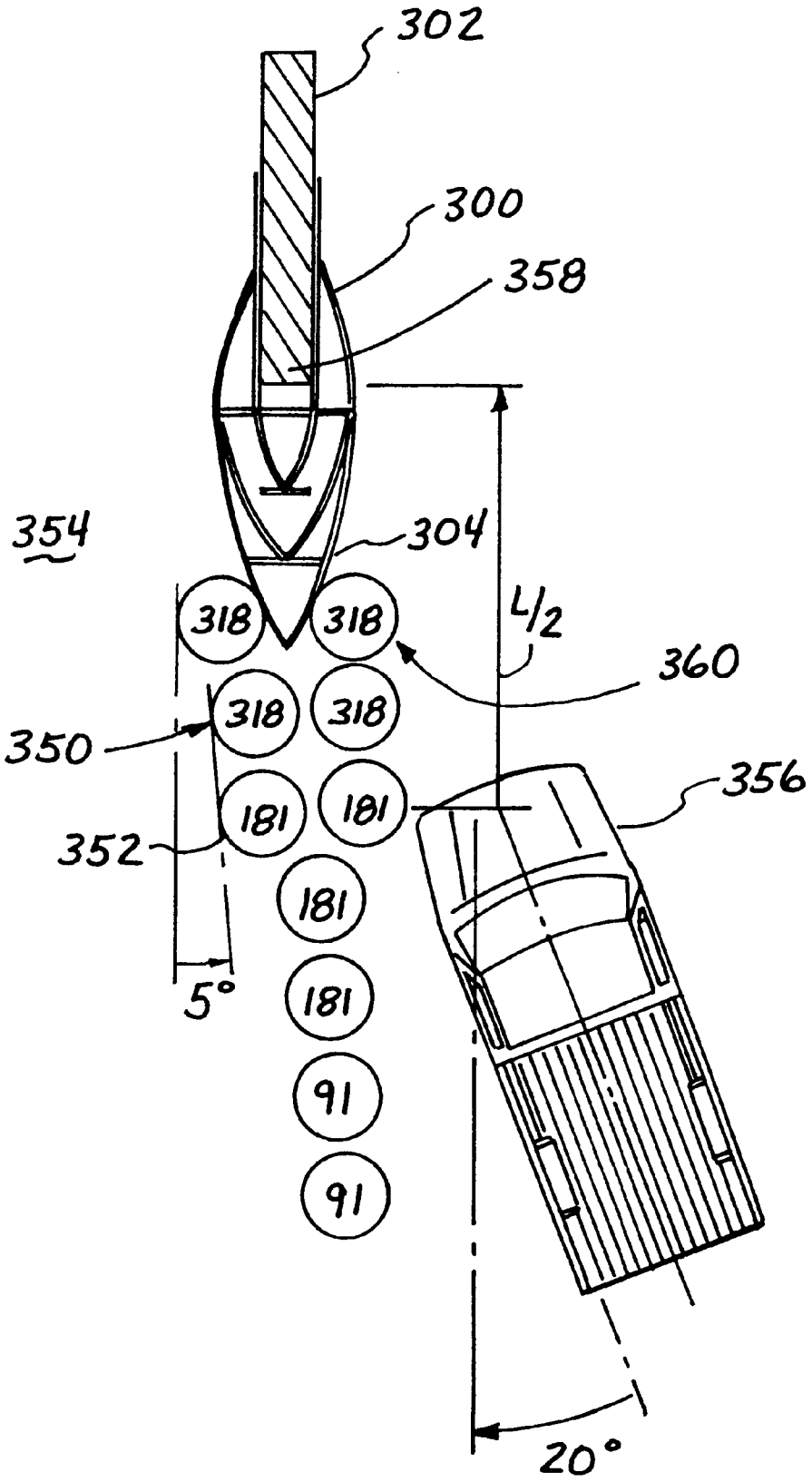
FIG. 24 shows the attenuator shown in FIG. 22 extending into a sand barrel array.

Referring now to FIG. 24, attenuator 300 is shown with an array 350 of sand barrels 352 in front, forming an attenuation system 354. In the attenuation system 354, the attenuator 300 performs a redirection function for inhibiting vehicle 356 from colliding with the coffin corner 358 of the rigid backup 302. The array 350 performs the gating function of the system 354 by enabling the vehicle 356 to penetrate through the sand barrels 352.

In a preferred embodiment of the invention, the pointed initial section 304 of the attenuator 300 extends into a back portion 360 of the array 350. By extending in the array, the sand barrels 352 provide lateral support to the initial section 304 during vehicular side impacts. This support is relevant in that the shown embodiment does not have an axial movement guide (See FIG. 21). Other embodiments of the invention may have attenuation systems comprising an attenuator, an arrays of sand barrels, and an axial movement guide. Other embodiments of the invention may use any equivalent to the sand barrels 352, such as containers filled with suitable particulate mass.

Figure 25:
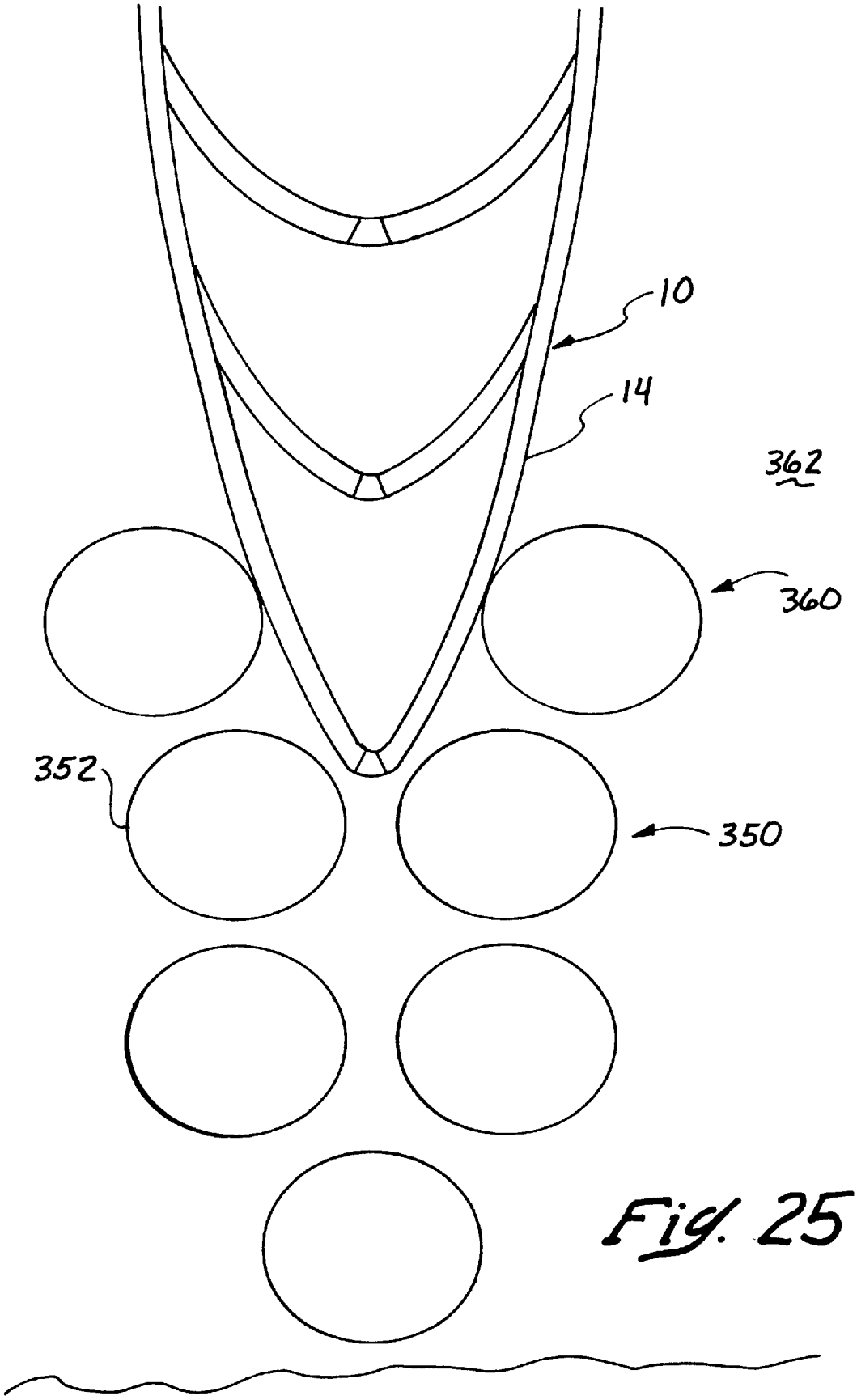
FIG. 25 shows the attenuator shown in FIG. 1 extending into a sand barrel array.

Now referring to FIG. 25, the attenuation system 362 is comprised of the attenuator 10 and the array 350 of sand barrels 352. In the system 362, attenuator 10 performs the redirection function while the array 350 performs the gating function. As with attenuation system 354, the pointed initial section 14 of the attenuator 10 extends into the back portion 360 of the array 350. By extending in the array, the sand barrels 352 provide lateral support to the initial section 14 during vehicular side impacts. This support is relevant in that the shown embodiment does not have an axial movement guide (See FIG. 21). Other embodiments of the invention may have attenuation systems comprising an attenuator, an arrays of sand barrels, and an axial movement guide.

The present invention may be embodied in other specific forms without departing from its spirit or essential attributes. For example, embodiments of the invention include attenuation systems of attenuators of any described variation paired with an array of containers holding particulate mass. Further, embodiments of the invention include axial movements guides attached to attenuators of any described variation. Accordingly, reference should be made to the appended claims, rather than to the foregoing specification, as indicating the scope of the invention.

I claim:

1. An energy absorbing guardrail crash attenuator system for installation in front of a rigid backup, the attenuator system comprising:

a. a compressible initial section at a front end of the attenuator system comprising:

i. two initial section side panels of approximately the same length and extending horizontally comprising front ends disposed distally to the rigid backup and back ends disposed proximate to the rigid backup;

ii. initial section joint that flexibly attaches the initial section side panels front ends, whereby forming an initial section interior angle at the initial section joint that is approximately bisected by a horizontal axis; and iii. initial section back attachment means for connecting the initial section side panel back ends to a backwardly adjacent compressible intermediate section, wherein each initial section side panel bows away from the axis whereby, when an axially oriented force is directed against the initial section and toward the rigid backup, the initial section side panels bend away from the axis and the initial section axially compresses;

b. at least one compressible intermediate section behind the initial section comprising:

i. two intermediate section side panels of approximately the same length and extending horizontally comprising front ends disposed distally to the rigid backup, and back ends disposed proximate to the rigid backup;

ii. intermediate section joint that flexibly attaches the intermediate section side panels front ends, whereby forming an intermediate section interior angle at the intermediate section joint that is approximately bisected by the axis; and iii. intermediate section back attachment means for connecting the intermediate section back ends to a backwardly adjacent compressible section, wherein each intermediate section side panel bows away from the axis whereby, when an axially oriented force is directed against the intermediate section and toward the rigid backup, the intermediate section side panels bend away from the axis and the intermediate section axially compresses, and wherein the intermediate section joint is disposed between forwardly adjacent compressible section side panels; and c. a compressible terminal section between the at least one intermediate section and the rigid backup comprising:

i. two terminal section side panels of approximately the same length and extending horizontally comprising front ends disposed distally to the rigid backup and back ends disposed proximate to the rigid backup;

ii. terminal section joint that flexibly attaches the front ends of the terminal section side panels, whereby forming an terminal section interior angle at the terminal section joint that is approximately bisected by the axis; and iii. terminal section attachment means for attaching the terminal section side panel back ends to the rigid backup, wherein each terminal section side panel bows away from the axis whereby, when an axially oriented force is directed against the terminal section and toward the rigid backup, the terminal section side panels bend away from the axis and the terminal section axially compresses, and wherein the terminal section joint is disposed between forwardly adjacent compressible section side panels.

2. The attenuator system of claim 1, further comprising panel bending means for facilitating the axial compression of the initial section.

3. The attenuator system of claim 2, wherein the panel bending means comprises one or more holes extending through one or more of the side panels of the initial section, at least one intermediate section, and the terminal section.

4. The attenuator system of claim 2, wherein said panel bending means comprises one or more embossed vertical ribs extending from interior surfaces of one or more of the side panels of the initial section, at least one intermediate section, and the terminal section.

5. The attenuator system of claim 4, wherein the embossed vertical ribs comprise horizontal slots.

6. The attenuator system of claim 1, wherein the back attachment means of the initial section and the at least one intermediate section comprises hinge joint for attaching each side panel back end to an exterior surface of the backwardly adjacent compressible section side panels, whereby enabling the back ends to pivot out from the adjacent side panel exterior surface.

7. The attenuator system of claim 6, wherein the hinge joint comprises:

a. one or more tabs extending from each side panel back end and toward the rigid backup, the tabs comprising a first portion proximate to the back end and a second portion distal to the back end;

b. pull-through bolt assemblies attaching the tab first portions to the exterior surface of the backwardly adjacent compressible section side panels; and c. standard nut and bolt assemblies attaching the tab second portions to the exterior surface whereby, when the respective section compresses, the pull-through bolt assemblies pull through the tab first sections as the side panels back end pivots out from the adjacent side panel exterior surface.

8. The attenuator system of claim 7, wherein cross tensioning members extend between one or more opposing pull-through bolt assemblies.

9. The attenuator system of claim 8, wherein the cross tensioning member is a metal strip extending between, and attached to, nuts of the opposing initial section pull-through bolt assemblies.

10. The attenuator system of claim 8, wherein the cross tension member is a rod comprising ends engagable with bolts of the opposing pull-through bolt assemblies.

11. The attenuator system of claim 6, wherein:

a. the terminal section back ends extend along sides of the rigid backup b. the back attachment means of the terminal section comprises terminal section hinge joint for attaching each side panel back end of the terminal section to the sides of the rigid backup, whereby enabling the terminal section back ends to pivot out from the rigid backup sides.

12. The attenuator system of claim 11, wherein the terminal section hinge joint comprises:

a. one or more tabs extending from each terminal section side panel back end and away from the attenuator system front end, the tabs comprising a first portion proximate to the back end and a second portion distal to the back end;

b. pull-through bolt assemblies attaching the tab first portions to the rigid backup sides; and c. standard nut and bolt assemblies attaching the tab second portions to the rigid backup sides whereby, when the terminal section compresses, the pull-through bolt assemblies pull through the tab first sections as the side panels back end pivots out from the rigid backup side.

13. The attenuator system of claim 11, further comprising gating means for controlled penetration of a vehicle, wherein at least a first portion of the gating means is disposed in front of the initial section.

14. The attenuator system of claim 13, wherein the gating means comprises an array of containers holding particulate mass.

15. The attenuator system of claim 13, wherein a second portion of the gating means is disposed adjacent to the initial section side panels.

16. The attenuator system of claim 15, wherein the gating means comprises an array of containers holding particulate mass.

17. The attenuator system of claim 1, wherein the initial, at least one intermediate, and terminal sections comprise w-beam guardrails or thrie-beam guardrails.

18. The attenuator system of claim 1, further comprising gating means for controlled penetration of a vehicle, wherein at least a first portion of the gating means is disposed in front of the initial section.

19. The attenuator system of claim 18, wherein the gating means comprises an array of containers holding particulate mass.

20. The attenuator system of claim 18, wherein a second portion of the gating means is disposed adjacent to the initial section side panels.

21. The attenuator system of claim 20, wherein the gating means comprises an array of containers holding particulate mass.

22. The attenuator system of claim 1, further comprising an axial movement guide comprising:

a. a guide plate mounted on a surface below the row; and b. an upper structure that is slidably mounted in an axial direction to the guide plate and that is attached to the compressible initial section.

23. An energy absorbing guardrail crash attenuator system for installation in front of a rigid backup, the attenuator system comprising:

a. a compressible initial section at a front end of the attenuator system comprising:

i. two initial section side panels of approximately the same length and extending horizontally comprising front ends disposed distally to the rigid backup and back ends disposed proximate to the rigid backup;

ii. initial section joint that flexibly attaches the initial section side panels front ends, whereby forming an initial section interior angle at the initial section joint that is approximately bisected by a horizontal axis; and iii. initial section back attachment means for connecting the initial section side panel back ends to a backwardly adjacent compressible intermediate section, wherein each initial section side panel bows away from the axis whereby, when an axially oriented force is directed against the initial section and toward the rigid backup, the initial section side panels bend away from the axis and the initial section axially compresses;

b. a compressible intermediate section behind the initial section comprising:

i. two intermediate section side panels of approximately the same length and extending horizontally comprising front ends disposed distally to the rigid backup, and back ends disposed proximate to the rigid backup;

ii. intermediate section joint that flexibly attaches the intermediate section side panels front ends, whereby forming an intermediate section interior angle at the intermediate section joint that is approximately bisected by the axis; and iii. intermediate section back attachment means for connecting the intermediate section back ends to sides of the rigid backup, wherein each intermediate section side panel bows away from the axis whereby, when an axially oriented force is directed against the intermediate section and toward the rigid backup, the intermediate section side panels bend away from the axis and the intermediate section axially compresses, and wherein the intermediate section joint is disposed between forwardly adjacent compressible section side panels; and c. a compressible terminal section between the at least one intermediate section and the rigid backup comprising:

i. two terminal section side panels of approximately the same length and extending horizontally comprising front ends disposed distally to the rigid backup and back ends disposed proximate to the rigid backup;

ii. terminal section joint that flexibly attaches the front ends of the terminal section side panels, whereby forming an terminal section interior angle at the terminal section joint that is approximately bisected by the axis; and iii. terminal section attachment means for attaching the terminal section side panel back ends to the rigid backup, wherein each terminal section side panel bows away from the axis whereby, when an axially oriented force is directed against the terminal section and toward the rigid backup, the terminal section side panels bend away from the axis and the terminal section axially compresses, and wherein the terminal section joint is disposed between forwardly adjacent compressible section side panels.

24. The attenuator system of claim 23, wherein:

a. the side panels of the intermediate and terminal sections comprise horizontal corrugations; and b. the rigid backup sides have surfaces that complement the horizontal corrugations of the side panels of the intermediate and terminal sections.

25. The attenuator system of claim 24, further comprising gating means for controlled penetration of a vehicle, wherein at least a first portion of the gating means is disposed in front of the initial section.

26. The attenuator system of claim 25, wherein the gating means comprises an array of containers holding particulate mass.

27. The attenuator system of claim 25, wherein a second portion of the gating means is disposed adjacent to the initial section side panels.

28. The attenuator system of claim 27, wherein the gating means comprises an array of containers holding particulate mass.

29. The attenuator system of claim 23, wherein the initial, at least one intermediate, and terminal sections comprise w-beam guardrails or thrie-beam guardrails.

30. The attenuator system of claim 23, further comprising an axial movement guide comprising:

a. a guide plate mounted on a surface below the row; and b. an upper structure that is slidably mounted in an axial direction to the guide plate and that is attached to the compressible initial section.

31. An energy absorbing guardrail crash attenuator system for installation in front of a rigid backup comprising a coffin corner, the attenuator system comprising:

a. redirecting means for redirecting a vehicle away from the coffin corner, the redirecting means comprising a row of two or more compressible sections comprising left and right curved, metal side panels, the row of compressible sections extending in an axial direction from a front end and terminating in a back end that is attached to the rigid backup, wherein the compressible sections bend outwardly during axial compression; and b. gating means for controlled penetration of a vehicle, wherein at least a first portion of the gating means is disposed in front of the front end.

32. The attenuator system of claim 31, wherein the gating means comprises an array of containers holding particulate mass.

33. The attenuator system of claim 31, wherein a second portion of the gating means is disposed adjacent to the left and right side panels at the row front end.

34. The attenuator system of claim 33, wherein the gating means comprises an array of containers holding particulate mass.

35. The attenuator system of claim 31 further comprising a plurality of front joints that flexibly join respective left and right side panel front ends of each compressible section.

36. The attenuator system of claim 31 further comprising hinge joints connecting at least a portion of the left and right side panel back ends to exterior surfaces of rearwardly adjacent left and right side panels, respectively.

37. The attenuator system of claim 31 further comprising panel bending for facilitating the axial compression of the sections.

38. The attenuator system of claim 37, wherein the panel bending means comprises one or more holes extending through one or more of the side panels of sections.

39. An energy absorbing guardrail crash attenuator system for installation in front of a rigid backup comprising a coffin corner, the attenuator system comprising:

a. redirecting means for redirecting a vehicle away from the coffin corner, the redirecting means comprising a row of two or more compressible sections comprising left and right curved, metal side panels, the row of compressible sections extending in an axial direction from a front end and terminating in a back end that is engagable with the rigid backup, wherein the compressible sections bend outwardly during axial compression;

b. gating means for controlled penetration of a vehicle, wherein at least a first portion of the gating means is disposed in front of the front end; and c. hinge joints connecting at least a portion of the left and right side panel back ends to exterior surfaces of rearwardly adjacent left and right side panels, respectively, wherein the hinge joints comprise:

i. one or more tabs extending from each side panel back end and away from the row front end, the tabs comprising a first portion proximate to the back end and a second portion distal to the back end;

ii. pull-through bolt assemblies attaching the tab first portions to the exterior surfaces of rearwardly adjacent left and right side panels; and iii. standard nut and bolt assemblies attaching the tab second portions to the exterior surfaces of rearwardly adjacent left and right side panels whereby, when the sections axially compress, the pull-through bolt assemblies pull through the tab first sections as the side panels back ends pivot out from the exterior surfaces of rearwardly adjacent left and right side panels.

40. An energy absorbing guardrail crash attenuator system for installation in front of a rigid backup comprising a coffin corner, the attenuator system comprising:

a. redirecting means for redirecting a vehicle away from the coffin corner, the redirecting means comprising a row of two or more compressible sections comprising left and right curved, metal side panels, the row of compressible sections extending in an axial direction from a front end and terminating in a back end that is engagable with the rigid backup, wherein the compressible sections bend outwardly during axial compression;

b. gating means for controlled penetration of a vehicle, wherein at least a first portion of the gating means is disposed in front of the front end; and c. panel bending means for facilitating the axial compression of the sections, wherein said panel bending means comprises one or more embossed vertical ribs extending from interior surfaces of one or more of the side panels.

41. The attenuator system of claim 40, wherein the embossed vertical ribs comprise horizontal slots.

42. An energy absorbing guardrail crash attenuator system for installation in front of a rigid backup, the attenuator system comprising a row of two or more compressible sections comprising left and right curved, metal side panels, the row of compressible sections extending in an axial direction from a front end and terminating in a back end that is attached to the rigid backup, wherein the compressible sections bend outwardly during axial compression.

43. The attenuator system of claim 42 further comprising a plurality of front joints that flexibly join respective left and right side panel front ends of each compressible section.

44. The attenuator system of claim 42 further comprising hinge joints connecting at least a portion of the left and right side panel back ends to exterior surfaces of rearwardly adjacent left and right side panels, respectively.

45. The attenuator system of claim 42 further comprising panel bending means for facilitating the axial compression of the sections.

46. The attenuator system of claim 45, wherein the panel bending means comprises one or more holes extending through one or more of the side panels of the sections.

47. The attenuator system of claim 42 further comprising:

a. a plurality of front joints that flexibly join respective left and right side panel front ends of each compressible section;

b. hinge joints connecting at least a portion of the left and right side panel back ends to exterior surfaces of rearwardly adjacent left and right side panels, respectively; and c. panel bending means for facilitating the axial compression of the sections.

48. An energy absorbing guardrail crash attenuator system for installation in front of a rigid backup, the attenuator system comprising:

a. a row of two or more compressible sections comprising left and right curved, metal side panels, the row of compressible sections extending in an axial direction from a front end and terminating in a back end that is engagable with the rigid backup, wherein the compressible sections bend outwardly during axial compression; and b. hinge joints connecting at least a portion of the left and right side panel back ends to exterior surfaces of rearwardly adjacent left and right side panels, respectively, wherein the hinge joints comprise:

i. one or more tabs extending from each side panel back end and away from the row front end, the tabs comprising a first portion proximate to the back end and a second portion distal to the back end;

ii. pull-through bolt assemblies attaching the tab first portions to the exterior surfaces of rearwardly adjacent left and right side panels; and iii. standard nut and bolt assemblies attaching the tab second portions to the exterior surfaces of rearwardly adjacent left and right side panels whereby, when the sections axially compress, the pull-through bolt assemblies pull through the tab first sections as the side panels back ends pivot out from the exterior surfaces of rearwardly adjacent left and right side panels.

49. An energy absorbing guardrail crash attenuator system for installation in front of a rigid backup, the attenuator system comprising:

a. a row of two or more compressible sections comprising left and right curved, metal side panels, the row of compressible sections extending in an axial direction from a front end and terminating in a back end that is engagable with the rigid backup, wherein the compressible sections bend outwardly during axial compression; and b. panel bending means for facilitating the axial compression of the sections, wherein said panel bending means comprises one or more embossed vertical ribs extending from interior surfaces of one or more of the side panels.

50. The attenuator system of claim 49, wherein the embossed vertical ribs comprise horizontal slots.

* * * * *